United States Patent [19]

Petiteau

[11] 4,320,705

[45] Mar. 23, 1982

[54] SAFETY DEVICE FOR A PYROTECHNIC ASSEMBLY

[75] Inventor: Maurice R. Petiteau, Besancon, France

[73] Assignee: Societe Anonyme Sormel, Besancon, France

[21] Appl. No.: 127,834

[22] Filed: Mar. 6, 1980

[30] Foreign Application Priority Data

Mar. 19, 1979 [FR] France ..... 79 06883

[51] Int. Cl.[3] ..... F42C 15/26

[52] U.S. Cl. ..... 102/232; 102/235

[58] Field of Search ..... 102/231, 232, 235

[56] References Cited

U.S. PATENT DOCUMENTS

| | | | |
|---|---|---|---|
| 2,664,822 | 1/1954 | Hale | 102/231 |
| 3,013,496 | 12/1961 | Wenig | 102/235 |
| 3,075,465 | 1/1963 | Craig | 102/235 |
| 3,547,034 | 12/1970 | Popovitch et al. | 102/235 X |
| 3,608,494 | 9/1971 | Ziemba | 102/235 |

FOREIGN PATENT DOCUMENTS

| | | | |
|---|---|---|---|
| 2385076 | 6/1977 | France | 102/235 |
| 1199207 | 7/1970 | United Kingdom | 102/232 |

*Primary Examiner*—Peter A. Nelson

*Attorney, Agent, or Firm*—Merriam, Marshall & Bicknell

[57] ABSTRACT

The present invention relates to a safety device for a pyrotechnic assembly in a projectile, provided with an explosive charge, and comprising a mobile member actuated by a clockwork mechanism with pivoting regulator and with drive pinion and able to occupy two different positions, for the first of which the ignition of said explosive charge is prevented, while for the second of said positions the ignition of this explosive charge is possible, wherein said mobile member is housed in a recess in said projectile and encloses the clockwork mechanism, as well as a disengagement lever blocking in said first position any movement of said member with respect to the projectile but whose action may be inhibited by said clockwork mechanism and, in the first position, the axis of the pivoting regulator is merged with the axis of rotation of said projectile.

10 Claims, 15 Drawing Figures

SAFETY DEVICE FOR A PYROTECHNIC ASSEMBLY

The present invention relates to a safety device for a pyrotechnic assembly.

Safety devices are already known which comprise a fire screening flap placed in a pyrotechnic assembly between the ignition primer and the secondary detonation primer explosives. Such devices are used in artillery projectiles or in missiles. The fire-screening flap is generally a thick metallic element whose disengagement, i.e. whose putting aside from the pyrotechnic channel is controlled by an outside force, for example a clockwork mechanism enabling the moment of the explosion to be chosen.

These known safety devices comprise three main members, namely the ignition primer, the screening flap and the regulator system(anchor) of the clockwork system. In the case of a spinning projectile, for obvious reasons of good functioning, the axis of this regulator system must necessarily merge with the axis of rotation of the projectile. Consequently, in the known safety devices of the type mentioned hereinabove, the ignition primer, the screening flap and the anchor are disposed behind one another along the axis of rotation of the projectile. This results in the dimensions of the safety device being large along this axis and the length and shape of the ignition channel being disturbed by the relative position of the primer.

If the screening flap is located between the primer and the anchor or if the anchor is disposed between the primer and the screening flap, the fire must pass through the anchor to reach the secondary explosives from the primer.

If the primer is placed between the anchor and the flap, the connections of said primer with the exterior are difficult to effect. In the case of an electrical connection by wire or pin, it is necessary that these members pass close to the regulator, whilst in the case of a transmission of fire by pyrotechnic means upstream, the anchor and its support form a screen which is as much a hindrance as the first arrangement mentioned.

In order to obtain a safety device of the above-described type which, whilst being of small dimensions, so as to be able to be mounted in small-calibre ammunition, avoids the above-mentioned drawbacks of the known devices, it has already been envisaged to mount the regulator of the clockwork mechanism of the flap itself.

However, although such a solution allows an appreciable reduction in dimensions with respect to the devices mentioned at the beginning, such a device is still cumbersome and can virtually not be mounted in ammunitions whose diameter is smaller than 30 mm.

It is an object of the present invention to provide a safety device for a pyrotechnic assembly which may be miniaturized to such an extent that its largest dimension may be reduced to less than 10 mm.

To this end, according to the invention, the safety device for the pyrotechnic assembly of a spinning projectile provided with an explosive charge and comprising a mobile member actuated by a clockwork mechanism with pivoting regulator and able to occupy two different positions, for the first of which the ignition of the said explosive charge is prevented, whilst for the second of said positions the ignition of this explosive charge is possible, is noteworthy in that said mobile member is housed in a recess in said projectile and encloses said clockwork mechanism, its regulator, as well as a disengagement lever blocking in said first position any movement of said member with respect to the projectile, but whose action may be inhibited by said clockwork mechanism and, in the first position, the axis of the pivoting regulator is merged with the axis of rotation of said projectile.

Due to the invention, a compact unit is obtained whose thickness may be limited, since the mobile member performs the functions of screen whilst incorporating the control mechanism. Moreover, the whole member itself becomes a protecting element participating in safety, whilst in the known devices, only part of them acted as screen.

In an advantageous embodiment, the mobile member is constituted by a rotor adapted to rotate about an axis parallel to the axis of rotation of the projectile.

The displacement of the rotor from the first to the second positions may be due to the action of the centrifugal force on the rotor of which the centre of gravity is eccentric, even if its geometrical form is of revolution, to the action of at least one spring, or to the combined action of the centrifugal force and of a spring.

In a variant embodiment, the mobile member is constituted by a slide member of which the direction of slide is perpendicular to the axis of rotation of the projectile. In this case too, the displacement of the slide member between its two positions may be due solely to the centrifugal force, to at least one spring or to a combination of the two.

The mobile member may comprise a central body on either side of which are provided covers which are fast therewith and which, in the case of a rotor, each bear a pivot pin, for mounting the rotor in said recess in the projectile, the clockwork mechanism being housed at least in part in the central body.

The disengagement lever advantageously comprises at one of its ends a hook cooperating with a first notch on the periphery of the recess for housing the mobile member in the projectile, to maintain this member in the first position. This disengagement lever may further comprise a locking finger inhibited in the first position but adapted to cooperate with a second notch on the periphery of the recess, to maintain the mobile member in its second position.

This safety device according to the invention may comprise an inertia bolt and the latter may be provided either to block or to unblock, simultaneously, the regulator of the clockwork mechanism and the disengagement lever.

The drive pinion of the clockwork mechanism may comprise an eccentric mass; however, it may also be fast with a more eccentric arm.

The safety device according to the invention may:

either serve as screen only: in this case, the fire passes through a hole or is relayed by a pyrotechnic element placed in said hole;

or serve as primary or electric primer transporter; in this case, the ignition connection is established at the end of stroke of the mobile member, or by percussion, the transported primer then coming into alignment with a striker.

The invention will be more readily understood on reading the following description with reference to the accompanying drawings, in which.

In these Figures, like elements are indicated by like references.

Figure 1:
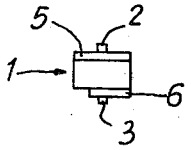
FIG. 1 is an outside view, shown in actual size, of a first embodiment of the safety device according to the invention, in the form of a rotor.
Figure 2:
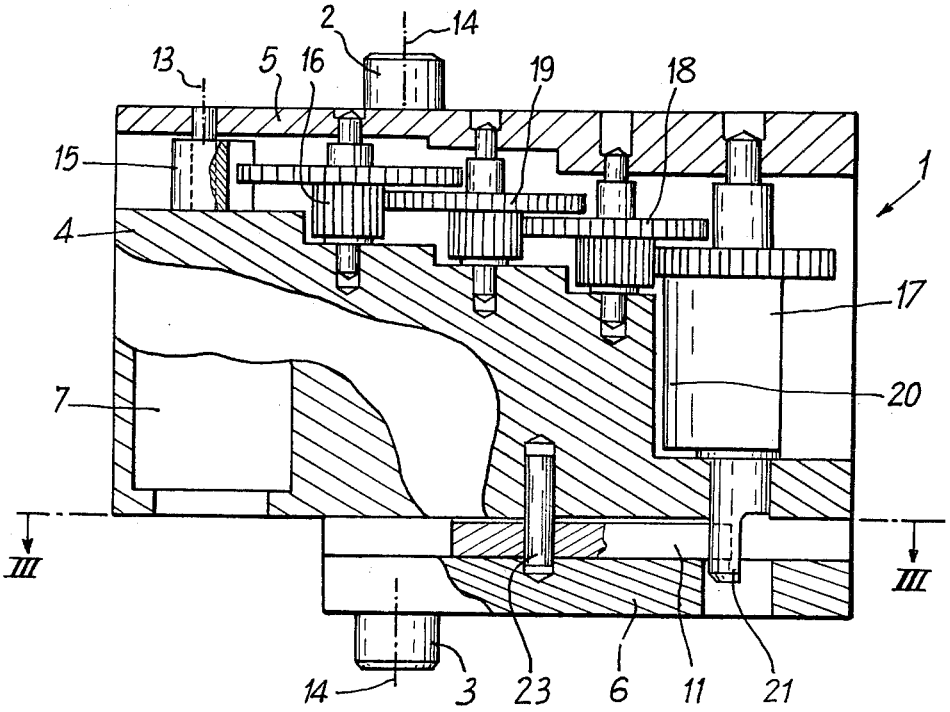
FIG. 2 is an enlarged schematic view in developed section of the device of FIG. 1.
Figure 3:
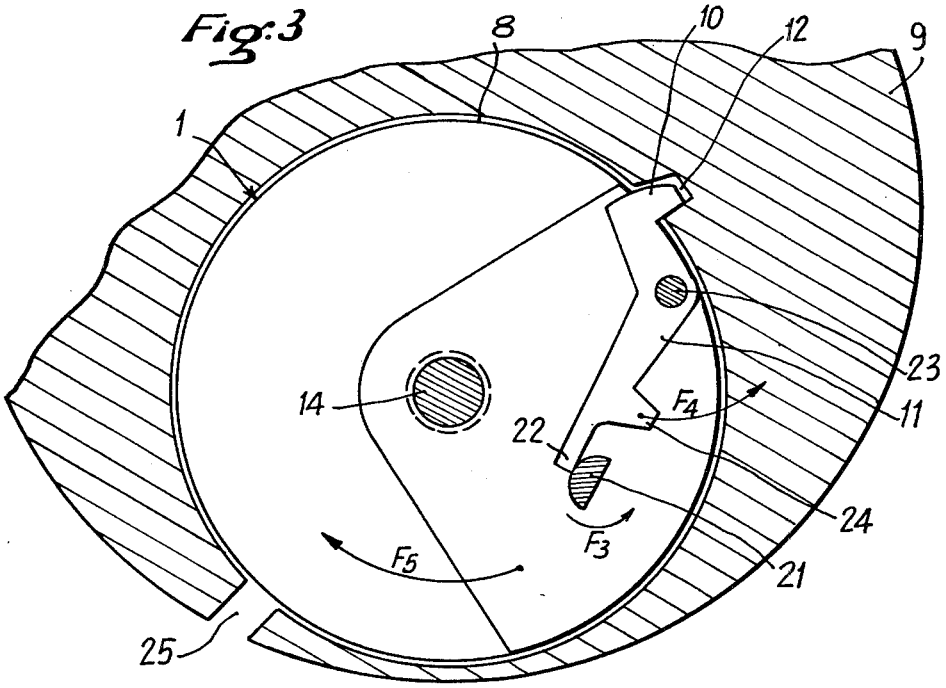
FIG. 3 is a transverse section through the device along line III—III of FIG. 2.

Referring now to the drawings, the device according to the invention, shown in FIGS. 1 to 4, is constituted by a rotor 1, provided with axial pivot pins 2 and 3 for rotation and comprising an intermediate cylindrical body 4, closed by two end covers 5 and 6, with which pivot pins 2 and 3 are respectively fast. The cover 5 is also cylindrical and covers all the face of the intermediate body 4, thereopposite. On the other hand, the cover 6 is in the form of a disc sector and covers only a part of the face of the intermediate body 4 thereopposite. The latter comprises an eccentric primer housing 7, adapted to be brought, by rotation of the rotor 1, into the axis of rotation 13 of the projectile which is the axis of the pyrotechnic assembly, said eccentric primer housing 7 not being covered by the cover 6. The rotor 1 is mounted in a cylindrical housing 8, provided in the spinning projectile 9 for which it is intended. This cylindrical housing 8 comprises bearings (not shown) in which are mounted the pivot pins 2 and 3 and which define therewith an axis of rotation 14 for the rotor, the axes 13 and 14 being parallel. However, the rotor 1 is normally prevented from rotating with respect to the projectile 9 by the hook 10 of an disengagement lever 11, engaged in a peripheral notch 12 in the housing 8.

The housing 8 is eccentric with respect to the axis of rotation 13 of the projectile, but said axis 13 is located inside said housing 8. Moreover, the centre of gravity of the rotor 1 is eccentric with respect to the axis 14.

Figure 4:
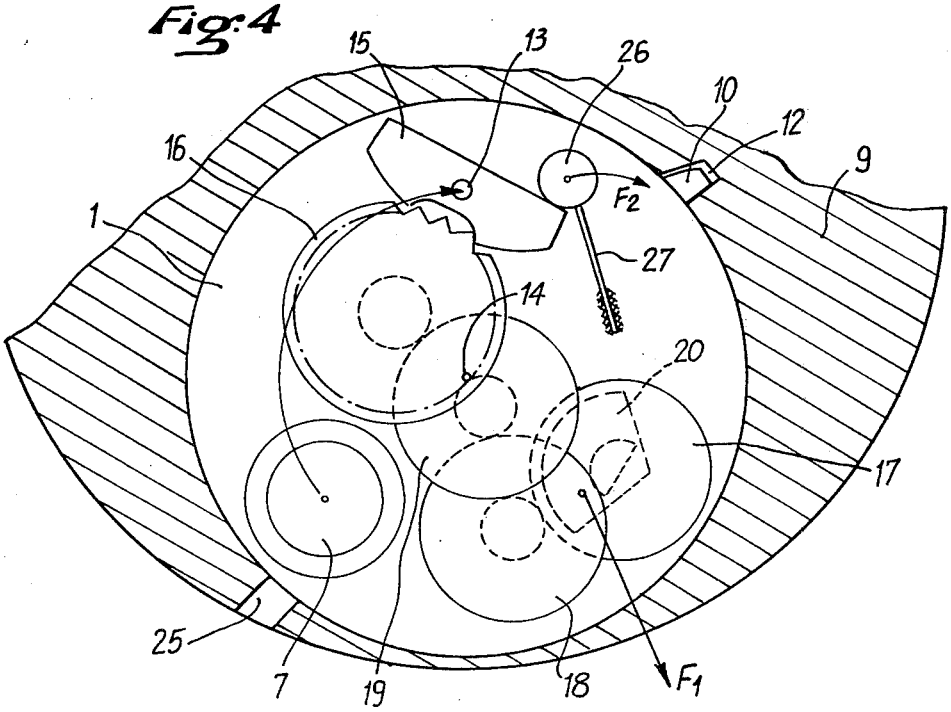
FIG. 4 illustrates the kinematics of the mechanism of the device of FIGS. 1 to 3.
Figure 5:
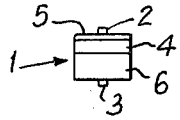
FIG. 5 is an outside view, shown in actual size, of a second embodiment of the safety device according to the invention, also in the form of a rotor.
Figure 6:
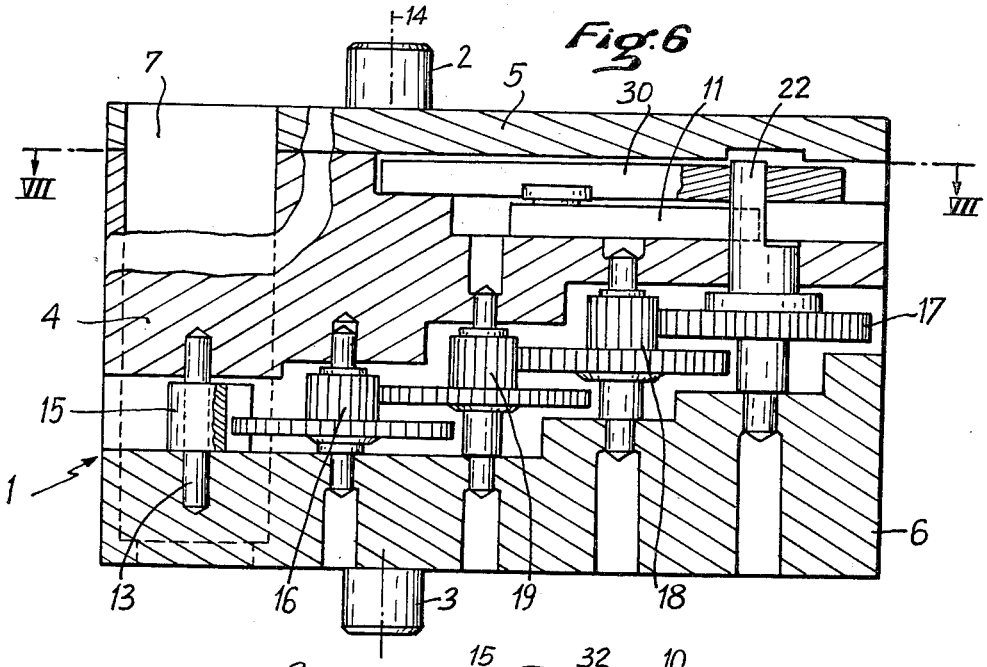
FIG. 6 is an enlarged schematic view in developed section of the device of FIG. 5.
Figure 7:
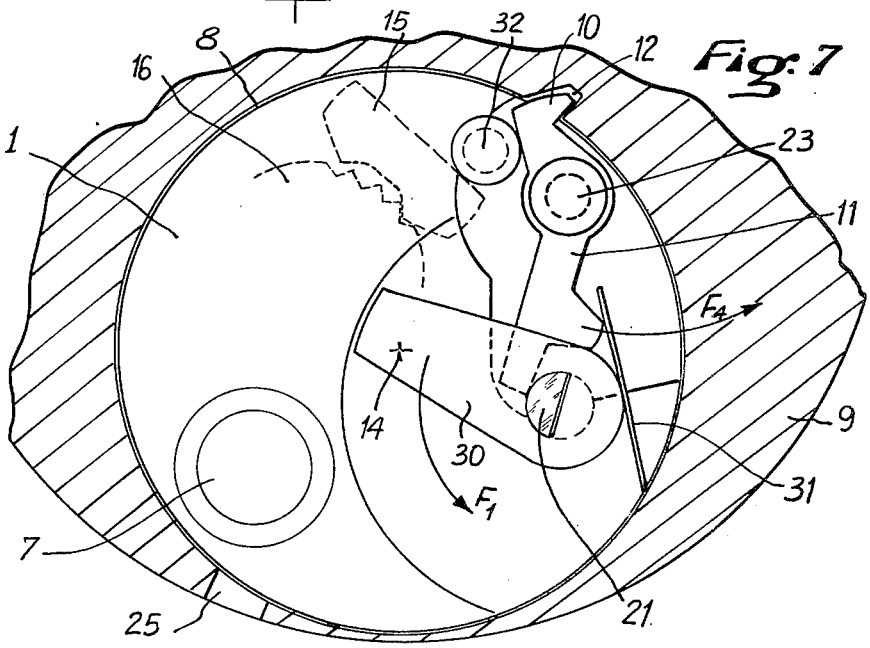
FIG. 7 is a transverse section along line VII—VII of FIG. 6.
Figure 8:
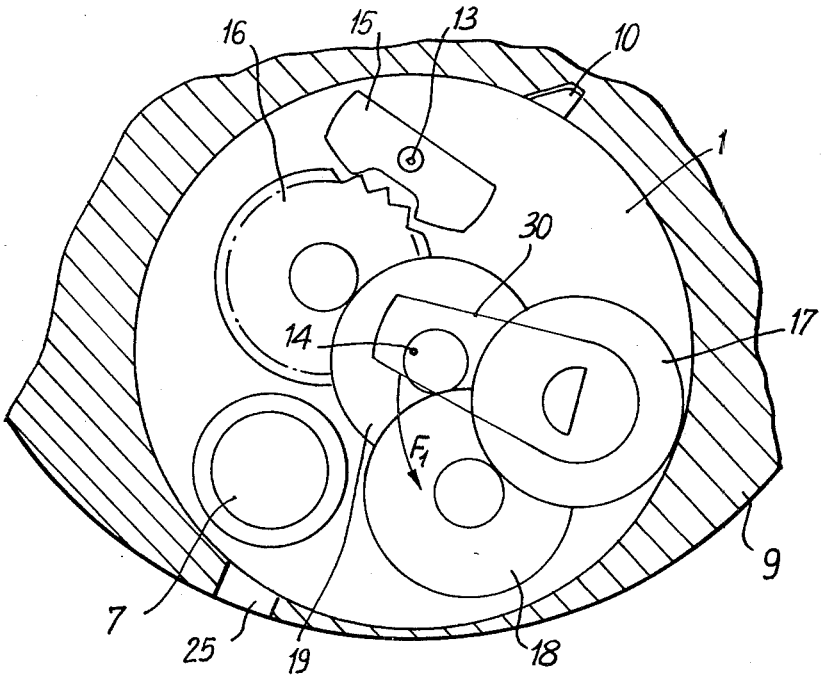
FIG. 8 illustrates the kinematics of the mechanism of the device of FIGS. 5 to 7.
Figure 9:
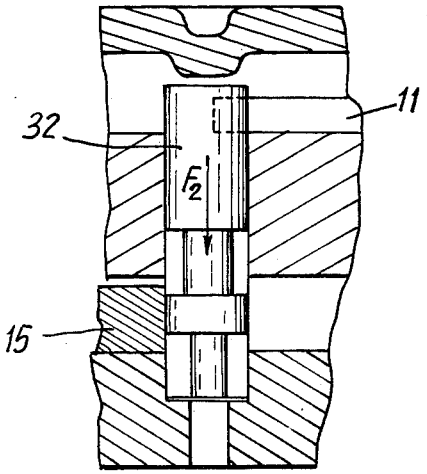
FIG. 9 shows in detail the inertia bolt of the device of FIGS. 5 to 8.

An anchor 15 and a pinion 16, in mesh with this anchor 15, whose axis of rotation is merged with the axis of rotation 13 of the projectile, are rotatably mounted between the intermediate cylindrical body 4 and the cover 5. The pinion 16 acts as escape pinion for a clockwork mechanism comprising, moreover, a drive pinion 17, a first intermediate pinion 18 and a second intermediate pinion 19. The axes of the different pinions 16 to 19 are parallel to the axis 13. FIG. 4 illustrates the kinematic chain formed by these pinions 16 to 19.

The drive pinion 17 comprises an eccentric mass 20 on which is exerted an inertia force $F_1$, when the rotor 1 is driven in rotation about the axis 13, as it is connected in rotation by the hook 10 with the projectile 9. The axis of the drive pinion 17 passes through the intermediate body 4 and comprises, at its end directed towards the cover 6, a half-moon section 21 cooperating with the end 22 of the disengagement lever 11 opposite the hook 10. The disengagement lever 11 is mounted between the intermediate body 4 and the cover 6, so as to be able to pivot about an axis 23, parallel to axes 13 and 14.

The disengagement lever 11 further comprises a locking finger 24 adapted to cooperate with a locking notch 25, provided on the periphery of the housing 8, when the rotor 1 was able to rotate with respect to the projectile 9.

At rest, the position of the drive pinion 17 is adjusted so that, via the half moon 21 and the end 22, the rotor 1 is locked in the housing 8 by the cooperation of the hook 10 and the notch 12 and so that the primer disposed in the housing 17 is outside the pyrotechnic chain.

Furthermore, the device according to the invention comprises an anchor bolt 26 pressed by a spring 27 against the anchor 15, to prevent the latter from pivoting about its axis.

Consequently, when the rotor 1 according to the invention is mounted in a spinning projectile 9 in the manner described and when this projectile describes its path on rotating about its axis 13, the anchor bolt 26, which blocks the chain 15 to 19 and therefore indirectly the rotor 1 in its housing 8, is subjected to an inertia force $F_2$. As long as this force $F_2$ is less than the force exerted by the spring 27 in the direction of the anchor 15, the lock 26 remains in place, blocking the clockwork mechanism and the rotor.

As soon as the force of inertia $F_2$ is greater than the force of the spring 27, the bolt 26 is displaced outwardly, unlocking the clockwork mechanism and the rotor. Consequently, the force $F_1$ exerted on the eccentric mass 20 of the drive pinion 17 sets the clockwork mechanism in motion. After a certain time, determined by this mechanism, the rotation of the drive pinion 17 causes the half moon 21 to rotate (arrow $F_3$) and the disengagement lever 11 rotates about the axis 23, in the direction of arrow $F_4$ under the action of the centrifugal force. The hook 10 then leaves the notch 12, this unlocking the rotor 1 from the projectile 9. The rotor 1 therefore rotates in its housing 8 about the axis 14 in the direction of the arrow $F_5$. When the locking finger 24 passes opposite the notch 25, it penetrates therein under the action of the centrifugal force (arrow $F_4$). The rotor 1 is again locked with respect to the projectile 9, but the primer housed in the housing 7 is interposed in the pyrotechnic assembly.

In the variant embodiment shown in FIGS. 5 to 9, the rotor 1 is composed of a cylindrical intermediate body 4, obturated at its two ends by likewise cylindrical covers 5 and 6, bearing the pivot pins 2 and 3. The primer housing 7 is in the body 4 and opens in the cover 5.

The rotor 1 is mounted to rotate in the housing 8 provided in the spinning projectile 9 and is prevented from rotating by the hook 10 of the disengagement lever 11, engaged in the peripheral notch 12.

Between the intermediate cylindrical body 4 and the cover 6 are mounted an anchor 15, a pinion 16, a drive pinion 17, a first intermediate pinion 18 and a second intermediate pinion 19. Instead of comprising an eccentric mass as in the case of FIGS. 1 to 4, the drive pinion 17 is fast, by its half-moon end 21, with an eccentric arm 30 housed between the intermediate body 4 and the cover 5. Similarly, between the body 4 and the cover 5 is housed the disengagement lever 11, mounted to pivot about its axis 23. A safety centrifugal spring leaf 31, fast with a projectile 9 and cooperating with the locking finger 24, presses the hook 10 in the notch 12.

Furthermore, the device according to FIGS. 5 to 9 comprises a sliding inertia bolt 32 passing through the central body 4 and adapted either to block the disengagement lever 11 and the anchor 15 simultaneously, or to release the disengagement lever 11 and the anchor 15 simultaneously.

Thus, when the rotor 1, whose centre of gravity is eccentric with respect to the axis 14, is mounted in a spinning projectile 9 and this projectile describes its path on rotating about its axis 13, the inertia bolt 32 which directly blocks the chain 15 to 19 and the rotor 1 in its housing 8, is subjected to an inertia force $F_2$. As long as this force $F_2$ is sufficient to cause the bolt 32 to slide completely, the latter blocks the clockwork mechanism and the rotor.

As soon as the force of inertia $F_2$ is sufficiently great for the bolt to move in a sliding motion, the clockwork mechanism and the rotor are unlocked. Consequently, the force $F_1$ exerted on the eccentric arm 30 of the drive pinion 17 sets the clockwork mechanism in motion. After a certain time, determined by this mechanism, the rotation of the drive pinion 17 causes the half moon 21 to rotate and the disengagement lever 11, after retraction of the centrifugal spring 31, rotates about the axis 23, in the direction of arrow $F_4$ under the action of the centrifugal force. The hook 10 then leaves the notch 12 and the rotor 1 may rotate about the axis 14 until the locking finger 24 penetrates in the notch 25.

Figure 10:
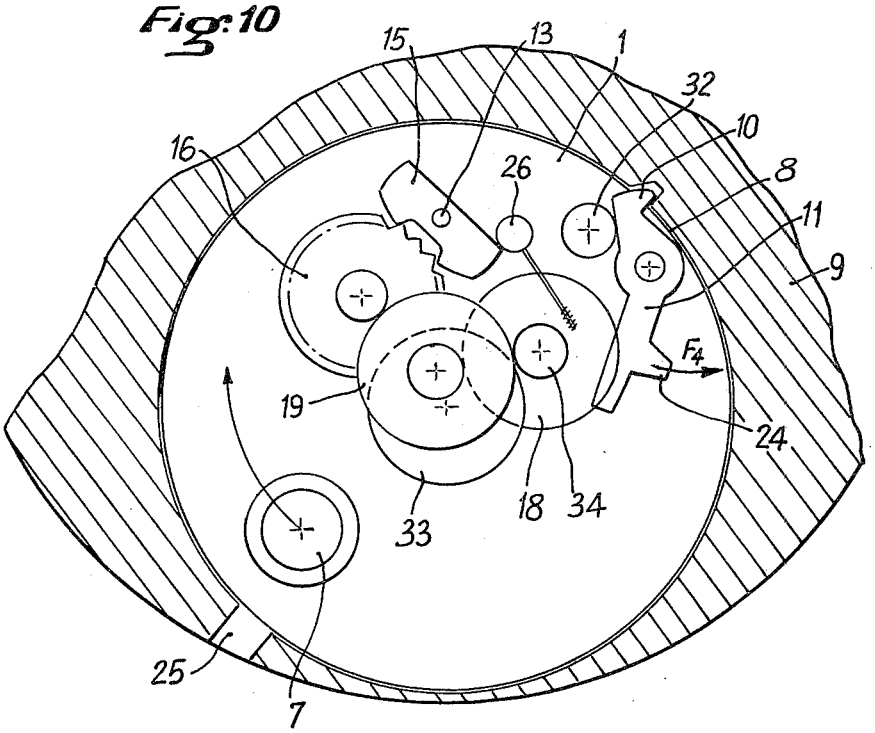
FIGS. 10 and 11 show, in schematic section, third and fourth embodiments of the safety device according to the invention, likewise in the form of a rotor.
Figure 11:
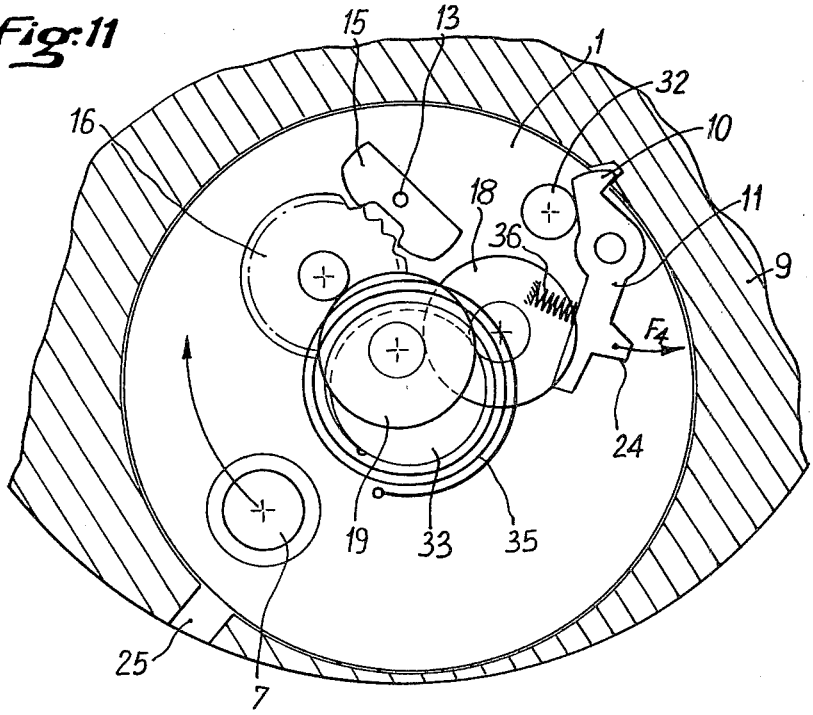

In the variant embodiment of FIG. 10, the drive pinion 17 has been eliminated and an elastically pressed anchor bolt 26 is provided for a spring 27, and an inertia bolt 32, blocking the disengagement lever 11. Furthermore, a toothed wheel 33 fast with the rotor 1 and concentric with respect thereto is in mesh with a pinion 34 fast in rotation with the intermediate pinion 18 and concentric with respect thereto. Thus, when under the action of the centrifugal force, the bolts 26 and 32 have respectively unblocked the anchor 15 and the disengagement lever 11, the clockwork mechanism starts to count and the hook retracts under the action of the force $F_4$. The action of the centrifugal force causes the rotor 1 to rotate, the centre of gravity of which is eccentric with respect to the axis 14, the pinion 34 rolling without slide on the fixed toothed wheel 33. The variant embodiment of FIG. 11 is similar to the device of FIG. 10. However, the bolt 26 has been eliminated but, on the other hand, a spiral spring 35 is provided to promote or provoke the rotation of the rotor 1, depending on whether or not the centre of gravity of the rotor is eccentric with respect to the axis 14. Moreover, a spring 36 is provided to assist the pivoting of the disengagement lever 11.

FIGS. 12 to 15 illustrate embodiments of the device according to the invention in which the mobile member is constituted by a slide member 40, housed in a radial recess 41 in the projectile 9. The slide member 40 comprises a mechanism 15, 19, 21, 30 to 32 similar to that of the device of FIGS. 5 to 9.

Moreover, it comprises an anchor bolt 26, 27. The hook 10 is engaged in a notch 12 provided in the wall of the recess 41 in the projectile 9.

When the centrifugal force reaches a sufficient value, the bolts 26 and 32 are retracted and, in the manner described hereinabove, the hook 10 leaves the notch 12. Under the action of the centrifugal force, the slide member 40 is subjected to a force $F_5$ and moves until the anchor or the primer hole 7 takes its place in the pyrotechnic assembly.

Figure 13:
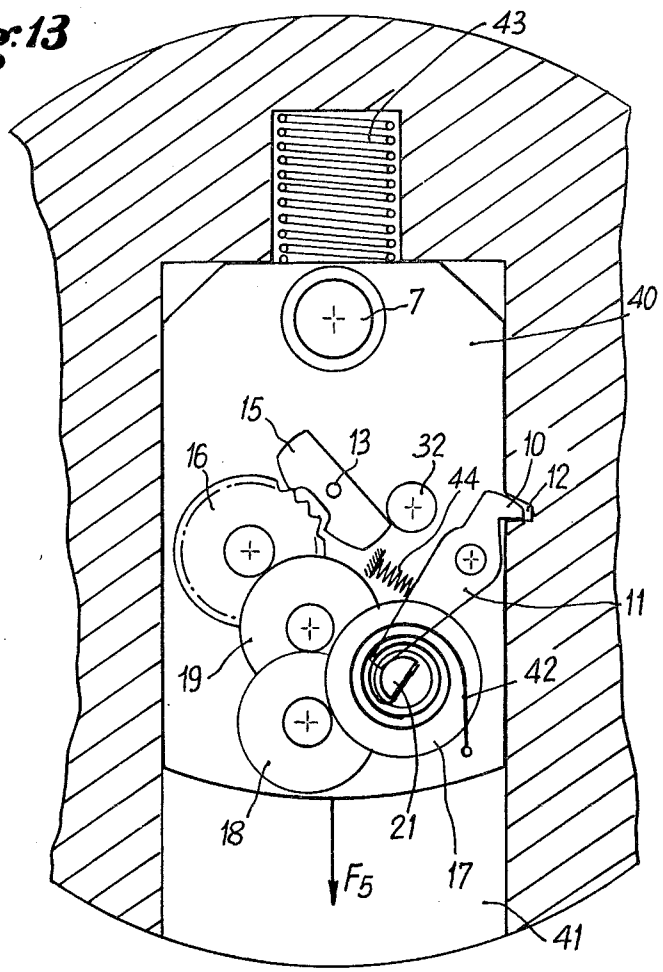
FIGS. 12 to 15 illustrate, in schematic section, variant embodiments of the safety device according to the invention, in the form of a slide member.

In the variant embodiment of FIG. 13, the eccentric arm 30 has been eliminated and replaced by a spiral spring 42, serving as drive for the pinion 17. Moreover, a spring 43 is provided to exert a force, in the direction of arrow $F_5$, on the slide member 40. Finally, a spring 44 is provided to assist the pivoting of the disengagement lever 11.

Figure 12:
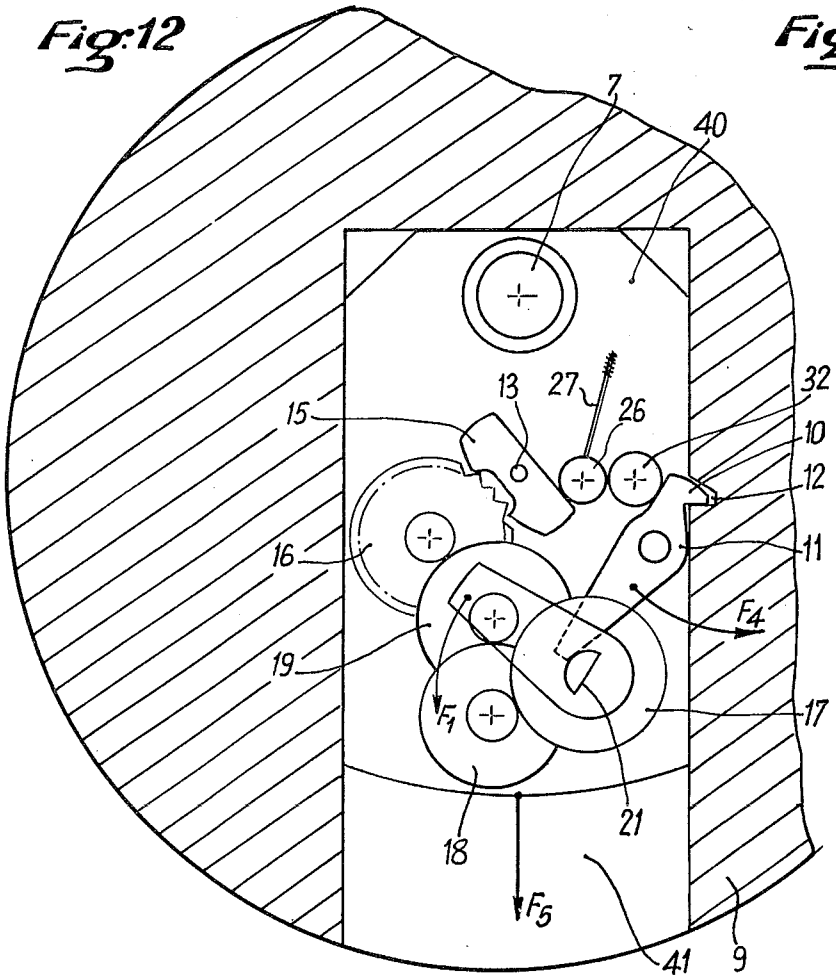
Figure 14:
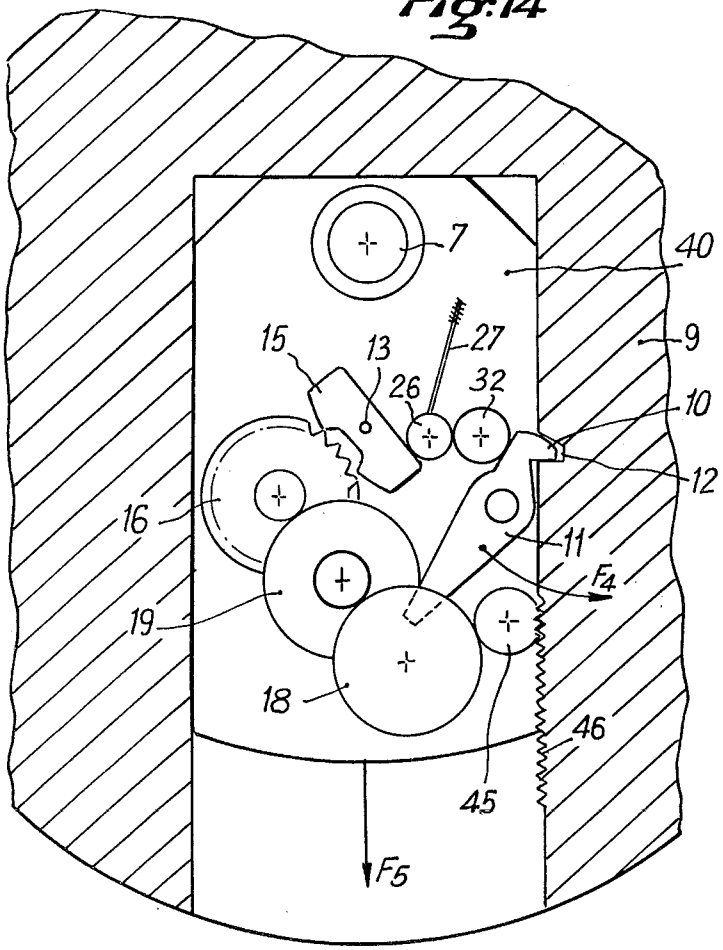

With respect to the device of FIG. 12, the device of FIG. 14 does not comprise a drive pinion 17, half moon 21, nor disengagement lever 30. On the other hand, the pinion 18 is in mesh with a pinion 45, itself in mesh with a rack 46 fast with the wall of the housing 41. Thus, to pass from its rest position to its active position, the slide member 40 moves under the action of the force $F_5$ so that the pinion 45 rolls on the rack 46.

Figure 15:
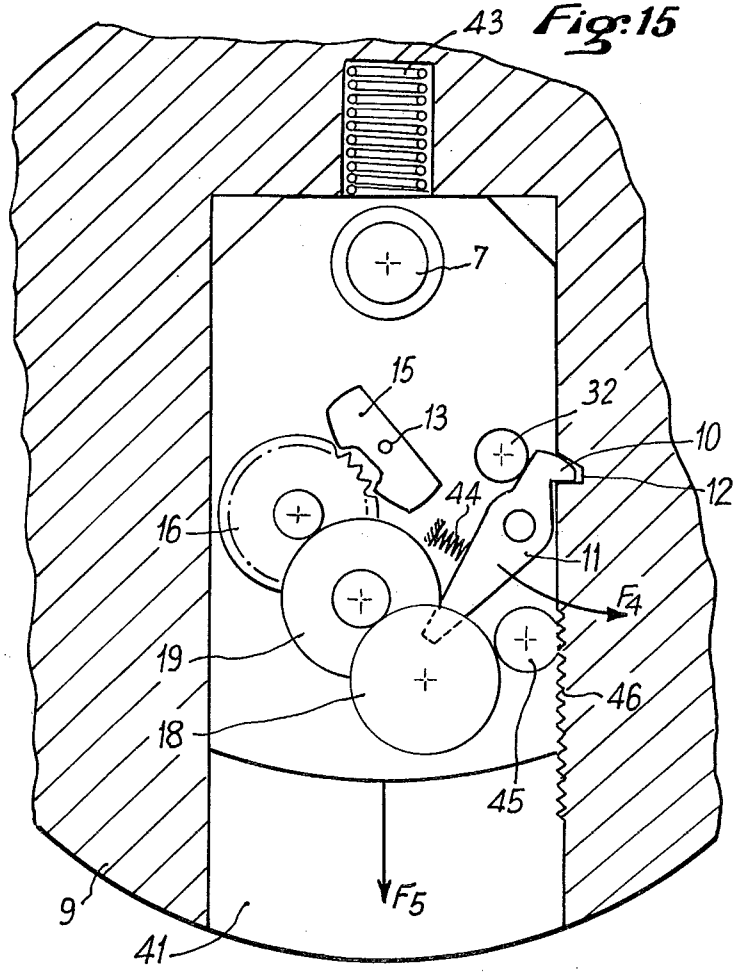

In the device of FIG. 15, the pinion 45 and the rack 46 are found again. Moreover, springs 43 and 44, as in the device of FIG. 13, are provided.

Although it has been mentioned in the above described examples that the housings 7 were intended to contain an ignition primer, it is obvious that these housings 7 may contain an intermediate charge between a primer and explosives disposed outside the rotors or slide members or could be simply a fire transmission channel between this primer and these explosives outside the mobile member. In these cases, the mobile member which would be interposed in the pyrotechnic assembly instead of being the beginning thereof, would act as retractable screen.

I claim:

1. A safety device for the pyrotechnic assembly of a spinning projectile provided with an explosive charge comprising:

a mobile member adapted to be housed in a recess in said projectile, said mobile member being movable within said recess between a first position in which ignition of said explosive charge is prevented and a second position in which ignition is possible;

a clockwork mechanism including a pivoting regulator;

a disengagement lever controlled by said clockwork mechanism for locking said mobile member in said first position and releasing said member for movement to said second position;

said clockwork mechanism and said disengagement lever being fixed to and movable with said mobile member, the pivotal axis of said pivoting regulator being coincident with the axis of rotation of said projectile while said mobile member is in said first position.

2. The safety device of claim 1, wherein said mobile member is in the form of a rotor.

3. The safety device of claim 1, wherein said mobile member is in the form of a slide member.

4. The safety device of claim 2, wherein the centre of gravity of the rotor is eccentric with respect to its axis of rotation.

5. The safety device of claim 3, wherein the direction of slide of said slide member is perpendicular to the axis of rotation of the projectile.

6. The safety device of claim 1, further including elastic means for biasing the displacement of the mobile member from said first to said second position.

7. The safety device of claim 2, wherein said rotor comprises a central body on either side of which are provided covers which are fast therewith and the clockwork mechanism is housed at least partially in said central body.

8. The safety device of claim 1, wherein the disengagement lever comprises at one of its ends a hook cooperating with a first notch on the periphery of the recess for housing said mobile member, to maintain the latter in the first position.

9. The safety device of claim 8, wherein the disengagement lever further comprises a locking finger inhibited in the first position of the mobile member but cooperating with a second notch on the periphery of the recess housing said mobile member to maintain the latter in its second position.

10. The device of claim 1, wherein it comprises an inertia bolt in order either to block or unblock, simultaneously, the regulator of the clockwork mechanism and the disengagement lever.

* * * * *